US012480488B2

(12) United States Patent
Black et al.

(10) Patent No.: US 12,480,488 B2
(45) Date of Patent: Nov. 25, 2025

(54) FLUID END WITH EXTENSION PLATE

(71) Applicant: GD Energy Products, LLC, Tulsa, OK (US)

(72) Inventors: James Black, Sperry, OK (US); Kale Woosley, Broken Arrow, OK (US); Vadim Kachkovskiy, Spring Mills, PA (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/754,667

(22) Filed: Jun. 26, 2024

(65) Prior Publication Data

US 2025/0012272 A1 Jan. 9, 2025

Related U.S. Application Data

(60) Provisional application No. 63/524,802, filed on Jul. 3, 2023.

(51) Int. Cl.
*F04B 53/16* (2006.01)
*F04B 19/22* (2006.01)
*F04B 53/00* (2006.01)

(52) U.S. Cl.
CPC ..... *F04B 53/16* (2013.01); *F04B 19/22* (2013.01); *F04B 53/007* (2013.01)

(58) Field of Classification Search
CPC ..... F04B 15/02; F04B 19/22; F04B 53/007; F04B 53/16
See application file for complete search history.

(56) References Cited

U.S. PATENT DOCUMENTS

| | | | | |
|---|---|---|---|---|
| 6,419,459 | B1 * | 7/2002 | Sibbing | F04B 53/22 417/360 |
| 8,465,268 | B2 | 6/2013 | Baxter | |
| 8,874,383 | B2 | 10/2014 | Gambier | |
| 9,188,123 | B2 | 11/2015 | Hubenschmidt et al. | |
| 10,184,470 | B2 | 1/2019 | Barnett, Jr. | |
| 11,294,402 | B1 | 4/2022 | Baskin | |

(Continued)

FOREIGN PATENT DOCUMENTS

WO 2019094622 A1 5/2019

OTHER PUBLICATIONS

Notification of Transmittal of International Search Report and Written Opinion including International Search Report and Written Opinion for International Application No. PCT/US2024/035689, mailed Nov. 4, 2024, 14 pages.

*Primary Examiner* — Audrey B. Walter
(74) *Attorney, Agent, or Firm* — Edell, Shapiro & Finnan, LLC

(57) ABSTRACT

A fluid end of a reciprocating pump that includes a housing defining multiple bores extending therein. In one embodiment, the present invention involves coupling a plate to a side of a smaller fluid end forging, thereby extending the overall length of the forging to capture the outer tie rods or stay rods that a larger forged fluid end typically captures. The plate allows a smaller forged fluid end to be utilized in a tie rod spacing that is outside of the smaller fluid end envelope. In one embodiment, the plate can partially capture the side or end surface of the fluid end. In another embodiment, the plate can fully capture the side or end surface of the fluid end.

20 Claims, 8 Drawing Sheets

(56) References Cited

U.S. PATENT DOCUMENTS

| | | | | |
|---|---|---|---|---|
| 2012/0213651 | A1* | 8/2012 | Ochoa | F04B 53/007 29/888.04 |
| 2020/0291928 | A1* | 9/2020 | Mullins | F04B 23/06 |
| 2023/0003207 | A1* | 1/2023 | Foster | F04B 1/0476 |

* cited by examiner

FLUID END WITH EXTENSION PLATE

CROSS REFERENCE TO RELATED APPLICATION

This patent application claims priority to and the benefit of U.S. Provisional Patent Application No. 63/524,802, entitled "FLUID END WITH EXTENSION PLATE," filed Jul. 3, 2023, the entire disclosure of which is hereby incorporated in its entirety.

FIELD OF INVENTION

The present invention relates to the field of high pressure reciprocating pumps and, in particular, to fluid ends of high pressure reciprocating pumps to which a plate is coupled to increase the size of the fluid ends.

BACKGROUND

High pressure reciprocating pumps are often used to deliver high pressure fluids during earth drilling operations. A reciprocating pump includes a fluid end casing or block that defines several different internal bores. The fluid end casing or block is manufactured to have a particular size.

There is a need to enable the use of a smaller fluid end forging in a larger fluid end application. There is also a need to enable a smaller fluid end forging to capture outer stay rods or tie rods in a larger fluid end, which are outside of the smaller fluid end envelope.

SUMMARY

The present invention relates to a fluid end of a reciprocating pump that includes a housing defining multiple bores extending therein. In one embodiment, the present invention involves coupling a plate to a side of a smaller fluid end forging, thereby extending the overall length of the forging to capture the outer tie rods or stay rods that a larger forged fluid end typically captures. The plate allows a smaller forged fluid end to be utilized in a tie rod spacing that is outside of the smaller fluid end envelope. In one embodiment, the plate can partially capture the side or end surface of the fluid end. In another embodiment, the plate can fully capture the side or end surface of the fluid end.

In one embodiment of the present invention, a fluid end assembly of a high-pressure reciprocating pump comprises a housing having at least one bore formed therein, the housing having a first surface, a second surface opposite the first surface, a first upper surface, a first lower surface opposite the first upper surface, and a first end surface, and a plate coupled to the housing proximate to the first end surface of the housing, the plate having a third surface, a fourth surface opposite the third surface, a second upper surface, a second lower surface opposite the second upper surface, and a second end surface, and a first inner surface, wherein when the plate is coupled to the housing, a tie rod can be captured between the plate and the housing.

In one embodiment, when the plate is coupled to the housing, the third surface is aligned with and co-planar with the first surface, the fourth surface is aligned with and co-planar with the second surface, and the second lower surface is aligned with and co-planar with the first lower surface. In another embodiment, the second upper surface of the plate includes a curved surface portion that defines a cavity, the housing includes a discharge flange extending from the first end surface, and a portion of the discharge flange engages the cavity. In yet another embodiment, the second upper surface is aligned with and co-planar with the first upper surface. In an alternative embodiment, the first inner surface of the plate is proximate to the first end surface of the housing when the plate is coupled to the housing.

In another embodiment, the housing includes a first recess formed in the first end surface, the first recess is sized to receive a portion of the tie rod therein, the plate includes a second recess formed in the first inner surface, the second recess is sized to receive a portion of the tie rod therein, the second recess is proximate to the first recess, and the first recess and the second recess collectively form a passageway for the tie rod. In one implementation, the passageway is a first passageway, the tie rod is a first tie rod, the housing includes a third recess formed in the first end surface, the plate includes a fourth recess, the fourth recess is proximate to the third recess, the third recess and the fourth recess collectively form a second passageway, and a second tie rod can be captured in the second passageway between the plate and housing.

In an alternative embodiment, the housing includes a third end surface opposite to the first end surface, the plate is a first plate, and the fluid end assembly further comprises a second plate coupled to the housing proximate to the third end surface, the second plate and the housing defining another passageway therebetween for another tie rod.

In an alternative embodiment of the present invention, a fluid end assembly of a high-pressure reciprocating pump comprises a housing having at least one bore formed therein, the housing having a first end surface and a second end surface opposite the first end surface, the first end surface having a first recess formed therein, the second end surface having a second recess formed therein, a first plate coupled to the housing proximate to the first end surface, the first plate including a first inner surface located proximate to the first end surface of the housing, the first inner surface having a third recess formed therein, the third recess and the first recess collectively forming a first tie rod passageway, and a second plate coupled to the housing proximate to the second end surface, the second plate including a second inner surface located proximate to the second end surface of the housing, the second inner surface having a fourth recess formed therein, the fourth recess and the second recess collectively forming a second tie rod passageway.

In another embodiment, the first plate includes several surfaces, the housing includes several surfaces, and at least one of the several surfaces of the first plate is aligned with and is co-planar with one of the several surfaces of the housing. In yet another embodiment, one of the several surfaces of the first plate is an upper surface, the upper surface includes a curved surface portion that defines a cavity, the housing includes a discharge flange extending from the first end surface, and a portion of the discharge flange engages the cavity. In an alternative embodiment, the housing includes a first upper surface, the first plate includes a second upper surface, and the second upper surface is aligned with and co-planar with the first upper surface when the first plate is coupled to the housing.

Alternatively, each of the first recess and the third recess is sized to receive a portion of a first tie rod therein, and each of the second recess and the fourth recess is sized to receive a portion of a second tie rod therein. Additionally, each of the first plate and the second plate is coupled to the fluid end housing via connectors extending through the respective first plate or second plate and into the fluid end housing.

In another alternative embodiment of the present invention, a fluid end assembly of a high-pressure reciprocating pump comprises a housing having at least one bore formed therein, the housing having a first end surface and a second end surface opposite the first end surface, the first end surface having a first recess formed therein, the second end surface having a second recess formed therein, a first plate coupled to the housing proximate to the first end surface via at least one connector, the first plate having a third recess formed therein, the third recess and the first recess collectively forming a first tie rod passageway, a second plate coupled to the housing proximate to the second end surface via at least one connector, the second inner surface having a fourth recess formed therein, the fourth recess and the second recess collectively forming a second tie rod passageway, a first tie rod extending through the first tie rod passageway, and a second tie rod extending through the second tie rod passageway.

In an alternative embodiment, the first plate includes several surfaces, the housing includes several surfaces, and at least one of the several surfaces of the first plate is aligned with and is co-planar with one of the several surfaces of the housing. In yet another embodiment, one of the several surfaces of the first plate is an upper surface, the upper surface includes a curved surface portion that defines a cavity, the housing includes a discharge flange extending from the first end surface, and a portion of the discharge flange engages the cavity. In an alternative embodiment, the housing includes a first upper surface, the first plate includes a second upper surface, and the second upper surface is aligned with and co-planar with the first upper surface when the first plate is coupled to the housing.

Alternatively, each of the first recess and the third recess receives a portion of the first tie rod therein, and each of the second recess and the fourth recess receives a portion of the second tie rod therein. Also, each of the first tie rod passageway and the second tie rod passageway includes a first portion with a first inner diameter and a second portion with a second inner diameter, the second inner diameter being larger than the first inner diameter.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a fluid end of a reciprocating pump. A fluid end according to the present invention has multiple bores formed therein. In addition, a fluid end is manufactured, such as by forging. A smaller fluid end forging can be manufactured and used in different applications. In some cases, a larger fluid end forging is needed for an application. By increasing the size of the fluid end according to the present invention, a smaller fluid end can be used in an application requiring a larger fluid end. In some embodiments, if a smaller fluid end forging can be used, overall fluid end manufacturing costs can be reduced.

The present invention relates to coupling one or more plates to a smaller fluid end to add to the size of the smaller fluid end, thereby making it larger. The resulting larger fluid end can be utilized in certain applications requiring a particularly sized fluid end.

In one embodiment, the present invention involves coupling a plate to a side of a smaller fluid end forging, thereby extending the overall length of the forging to capture the outer tie rods or stay rods that a larger forged fluid end typically captures. The plate allows a smaller forged fluid end to be utilized in a tie rod spacing that is outside of the smaller fluid end envelope. In one embodiment, the plate can partially capture the side or end surface of the fluid end. In another embodiment, the plate can fully capture the side or end surface of the fluid end.

According to the present invention, the plates are first pre-machined and then installed onto a smaller forging fluid end block by utilizing connectors, such as stud/nuts or standard bolts. The plates can be located on opposite sides of the fluid end block or casing. In the embodiment in which a plate fully captures the side of the fluid end casing, that plate also captures the discharge flange and allows it to be offset to resolve any geometry and stress issues.

In one embodiment, once the plates are installed, the assembly is then taken to a CNC machine to square the interfacing faces with the tie rod nut and sleeve. When the final tie rod machining process is complete, the fluid end can be installed in the normal tie rod configuration similarly to a larger forging fluid end that captures the outer tie rods.

In an alternative embodiment, a fluid end may be forged from a first material, and a plate can be made of a second material different from the first material. In one embodiment, the second material may be a cheaper material than the first material, thereby further reducing manufacturing costs, including the cost of raw materials.

Figure 1:
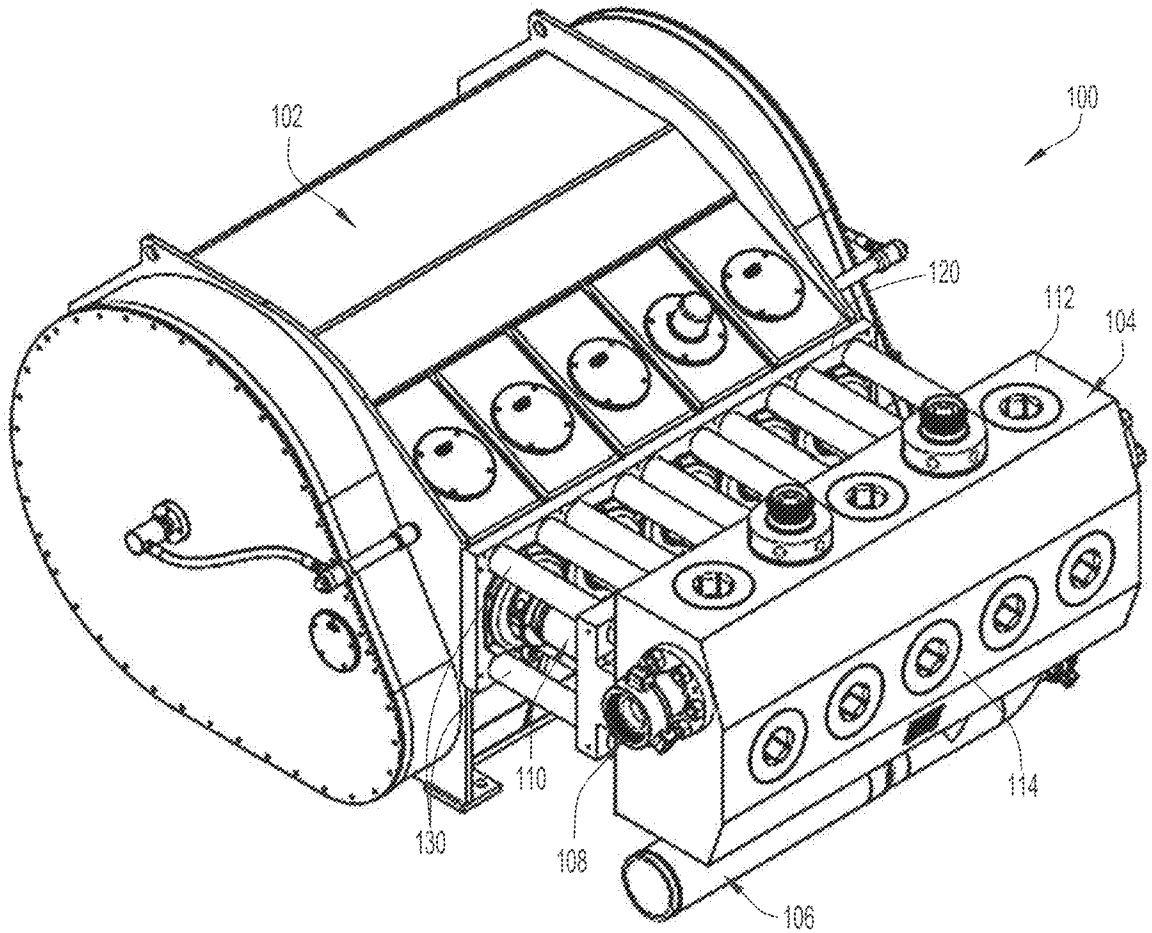
FIG.1 PRIOR ART
FIG. 1 is a perspective view of a prior art reciprocating pump including a fluid end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

In various embodiments, the fluid end 104 may be shaped differently and/or have different features, but may still generally perform the same functions, define similar structures, and house similar components. In particular, the fluid end casing 112 has an external surface 114 which may have different shapes in different embodiments.

Overall, in operation, fluid may enter fluid end 104 via multiple openings, and exit fluid end 104 via multiple openings. In some embodiments, fluid enters an opening via pipes of piping system 106, flows through a pumping chamber (not shown) formed in the fluid end 104 (due to movement of a reciprocating member 110, such as a plunger), and then flows through openings into a channel 108. However, piping system 106 and channel 108 are merely example conduits and, in various embodiments, fluid end 104 may receive and discharge fluid via any number of pipes and/or conduits, along pathways of any desirable size or shape.

Referring to FIG. 1, in pump 100, couplers 130 (e.g., tie rods, which are sometimes referred to as stay rods) are threaded to a mount plate 120 of a crosshead assembly of the power end 102 to position the fluid end 104 in close proximity to the power end 102.

Figure 2:
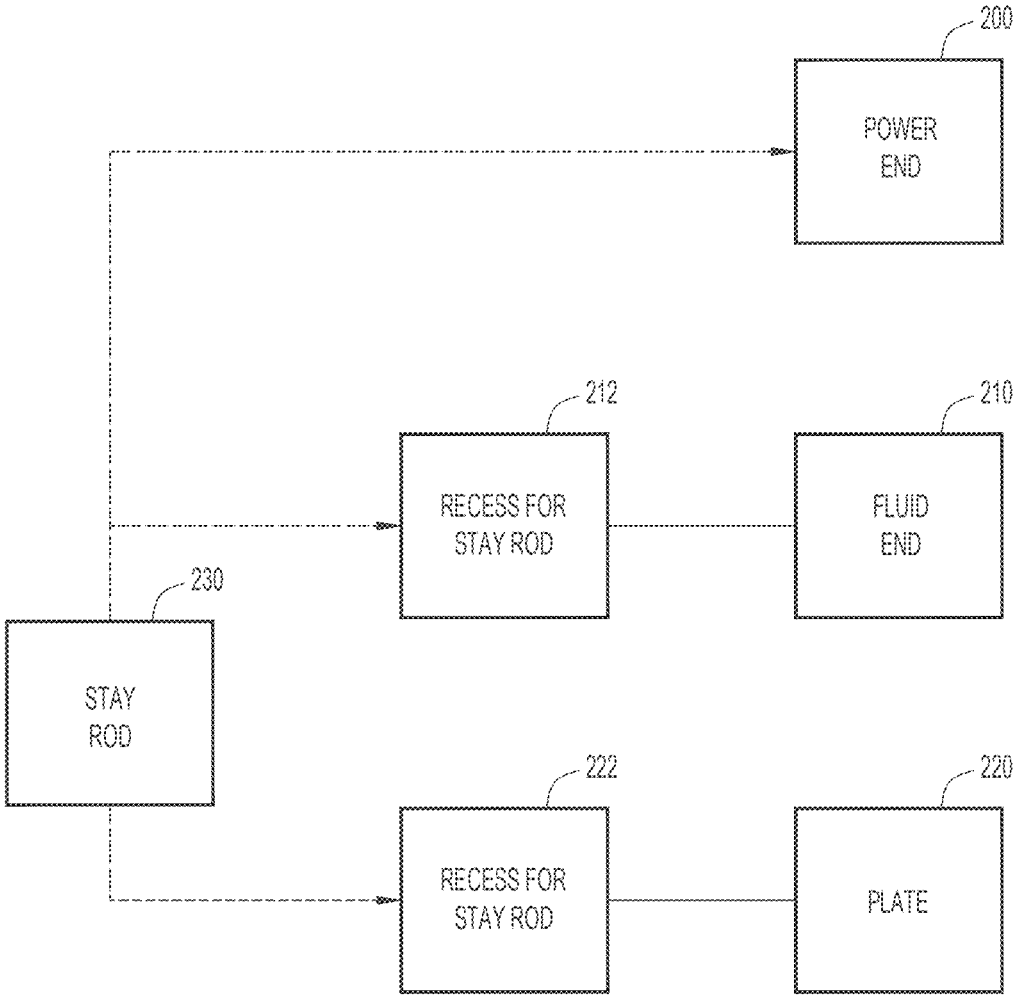
FIG. 2 is a schematic diagram of some components of an embodiment of a reciprocating pump according to the present invention.

Now turning to FIG. 2, a schematic diagram of an exemplary embodiment of a pump according to the present application is illustrated. In this embodiment, the pump includes a power end 200 and a fluid end 210. The fluid end 210 is coupled or mounted to the power end 200 using multiple tie rods or stay rods 230. While only one stay rod 230 is illustrated in FIG. 2, it is to be understood that multiple stay rods 230 are used to mount the fluid end 210 to the power end 200.

The present invention relates to using a plate 220 with a fluid end 210 to increase the size of the fluid end 210. In one embodiment, the plate 220 is coupled to the fluid end 210. In another embodiment, two plates 220 are coupled to the fluid end 210, each of which is located at opposite ends of the fluid end 210. By coupling a plate 220 to the fluid end 210, the overall size of the fluid end 210 increases. By coupling a second plate 220 to the fluid end 210, the overall size of the fluid end 210 increases even more. A plate 220 can be coupled to the fluid end 210 using bolts that extend through the plate 220 and engage the fluid end 210.

As shown in FIG. 2, the fluid end 210 includes a recess or receptacle 212 that receives at least part of a stay rod. Similarly, plate 220 includes a recess or receptacle 222 that receives at least part of a stay rod as well. When the plate 220 is coupled to the fluid end 210, recess 222 is located proximate to recess 212. Recess 212 and recess 222 collectively form a single receptacle for a particular stay rod, such as stay rod 230. In one embodiment, the formed combined receptacle can receive the stay rod 230 therein, thereby allowing the stay rod 230 to secure the fluid end 210 to the power end 200.

Figure 3:
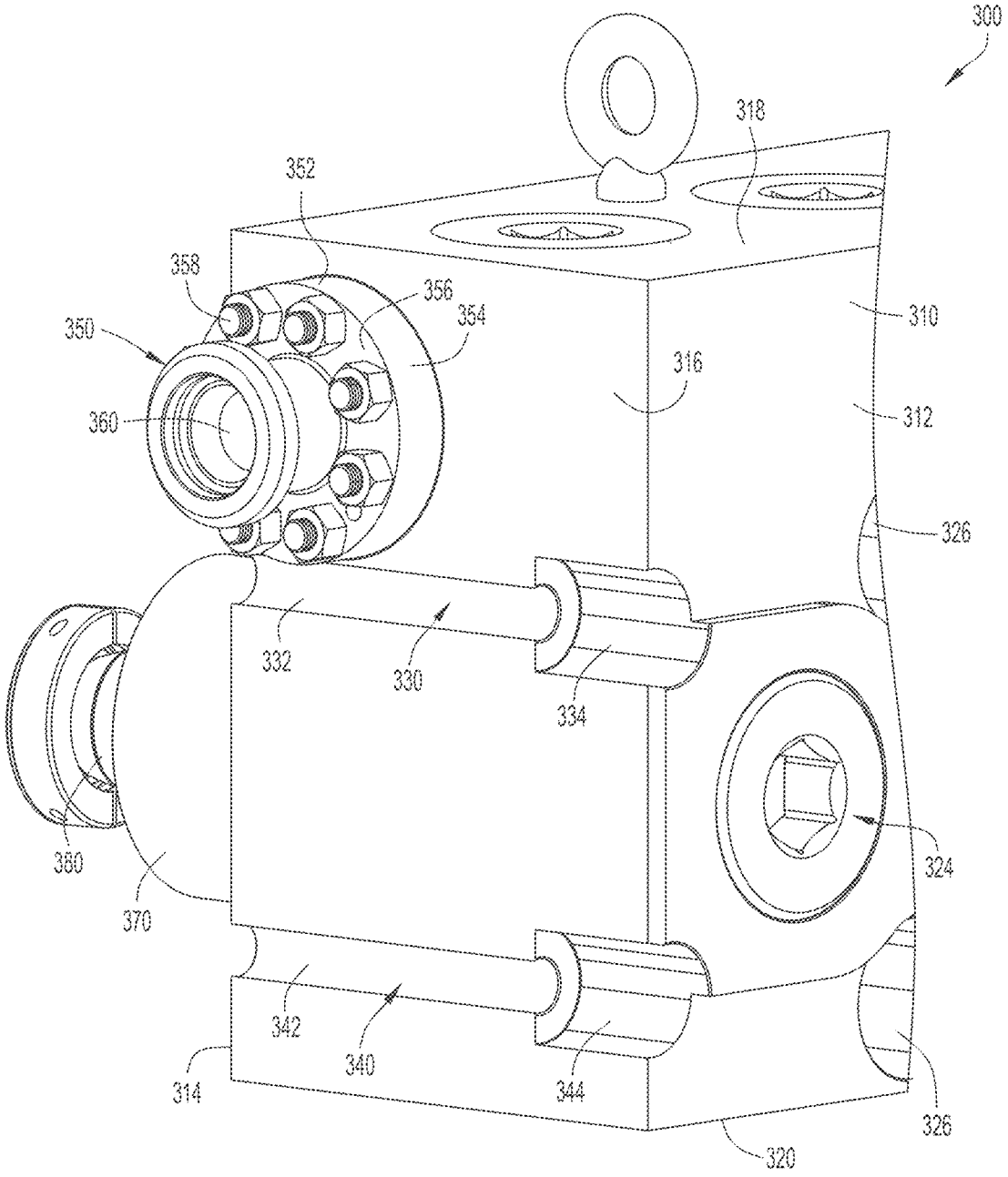
FIG. 3 is a perspective end view of a portion of an embodiment of a fluid end according to the present invention.

Turning to FIG. 3, a perspective end view of a portion of an embodiment of a fluid end according to the present invention is illustrated. In this embodiment, fluid end 300 includes a casing 310 with opposite surfaces 312 and 314, and an end surface 316. In addition, the casing 310 has an upper or top surface 318 and a lower or bottom surface 320 opposite to upper surface 318.

Casing 310 includes an access bore 324 formed therein. Casing 310 also includes through holes 326 that extend through the casing 310 from surface 312 to surface 314. Each of the through holes 326 receives a stay rod (not shown in FIG. 3) therein that is used to couple fluid end 300 to a power end (not shown).

In this embodiment, the end surface 316 of casing 310 includes a recess or receptacle 330 and a recess or receptacle 340 spaced apart from recess 330. Each of recess 330 and 340 is sized and shaped to receive a portion of a stay rod or tie rod. In an alternative embodiment, the end surface 316 of the casing 310 only includes a single recess or receptacle for a stay rod.

As shown in FIG. 3, recess 330 extends from surface 312 of casing 310 to surface 314 of casing 310. Recess 330 includes two different portions 332 and 334 in communication with each other. In this embodiment, portion 332 is shallower and narrower than portion 334. Portion 332 has a smaller radius of curvature than the radius of curvature of portion 334. Recess portion 332 is sized to receive a shank of a stay rod, and recess portion 334 is sized to receive an end of a stay rod, and in some embodiments, a nut coupled to the stay rod.

Similarly, recess 340 extends from surface 312 of casing 310 to surface 314 of casing 310. In addition, recess 340 is spaced apart from and extends parallel to recess 330. In particular, recess 340 has a longitudinal axis that extends parallel to the longitudinal axis of recess 330. Recess 340 also includes two different portions 342 and 344 in communication with each other. In this embodiment, portion 342 is shallower and narrower than portion 344. Portion 342 has a smaller radius of curvature than the radius of curvature of portion 344. Recess portion 342 is sized to receive a shank of a stay rod, and recess portion 344 is sized to receive an end of a stay rod.

As shown in FIG. 3, casing 310 includes at least one stuffing box 370 coupled thereto and a least one reciprocating element 380 proximate to the stuffing box 370. Casing 310 also includes a discharge end 350 coupled or mounted to end surface 316. Discharge end 350 includes a flange 352 and an outlet 360 through which fluid may flow. Flange 352 has a side surface 354 and an outer surface 356, each of which extends around the outlet 360. The flange 352 includes several through openings (not shown) into which connectors 358, such as bolts, are inserted and secured by nuts to retain the discharge end 350 to the casing 310. The discharge end 350 is coupled to the casing 310 above recess 330 and close to upper surface 318.

Figure 4:
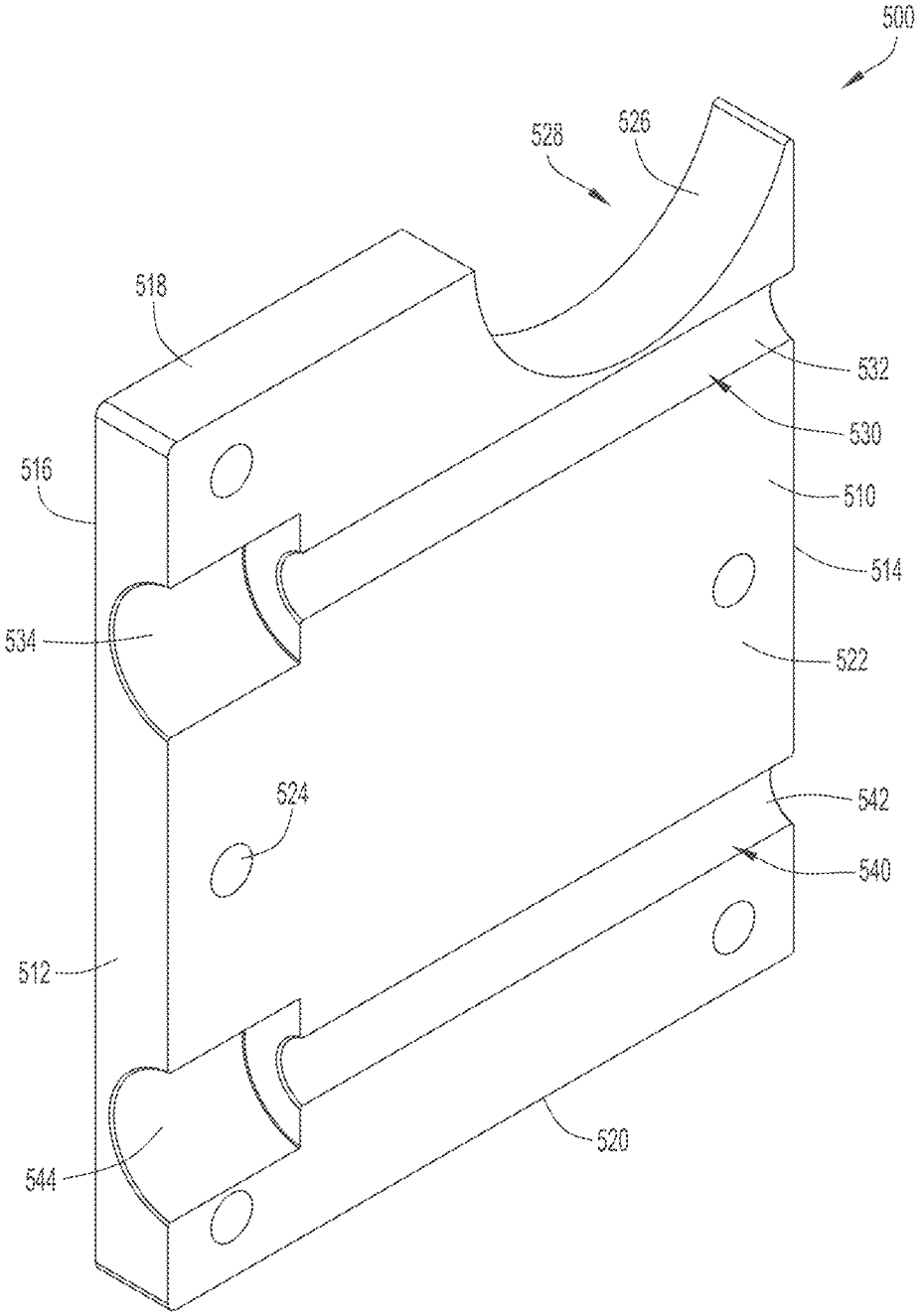
FIG. 4 is a perspective end view of an embodiment of a plate according to the present invention.

Turning to FIG. 4, a perspective view of an embodiment of a plate according to the present invention is illustrated. In this embodiment, plate 500 includes a body 510 that has a first surface 512 and a second surface 514 opposite to first surface 512. Plate body 510 also has an outer surface 516 and an inner surface 522. Plate body is wider (dimension between surfaces 512 and 514) than it is thicker (dimension between surfaces 516 and 522). Plate body 510 also has an upper surface 518 and a lower surface 520 opposite to upper surface 518.

Body 510 also has a cavity 528 formed therein. Cavity 528 is defined by a curved surface portion 526 of upper surface 518. In this embodiment, curved surface portion 526, and as a result, cavity 528, have generally arcuate shapes or configurations. Cavity 528 is discussed in more detail below relative to FIG. 5.

As shown in FIG. 4, body 510 includes a pair of recesses or receptacles 530 and 540 formed therein. Recess 530 and recess 540 are formed in the body 510 in inner surface 522. In this embodiment, recesses 530 and 540 in plate 500 are formed similarly to recesses 330 and 340 formed in casing 310.

Recess 530 extends from casing surface 512 to casing surface 514. Recess 530 includes two different portions 532 and 534 in communication with each other. In this embodiment, portion 532 is shallower and narrower than portion 534. Recess portion 532 is sized to receive a shank of a stay rod, and recess portion 534 is sized to receive an end of a stay rod.

Similarly, recess 540 extends from casing surface 512 to casing surface 514. Recess 540 is spaced apart from and extends parallel to recess 530, with a longitudinal axis of recess 540 extending parallel to the longitudinal axis of recess 530. Recess 540 includes two different portions 542 and 544 in communication with each other. Portion 542 is shallower and narrower than portion 544, with recess portion 542 being sized to receive a shank of a stay rod, and recess portion 544 being sized to receive an end of a stay rod.

As described below, plate 500 is coupled to fluid end casing 310 so that plate 500 is proximate to end surface 316 of casing 310. When plate 500 is coupled to fluid end casing 310 in that position, recess 530 in plate 510 is proximate to and aligned with recess 330 in casing 310. Recess 330 and 530 collectively form a through hole or passage for a stay rod. Similarly, recess 540 in plate 510 is proximate to and aligned with recess 340 in casing 310. Recess 340 and recess 540 also collectively form a through hole or passage for a stay rod.

Body 510 includes several holes 524 extending through the body 510 from its inner surface 522 to its outer surface 516. In this embodiment, body 510 has five through holes 524, each of which can receive a bolt therethrough to couple the plate 500 to the fluid end casing 310.

Figure 5:
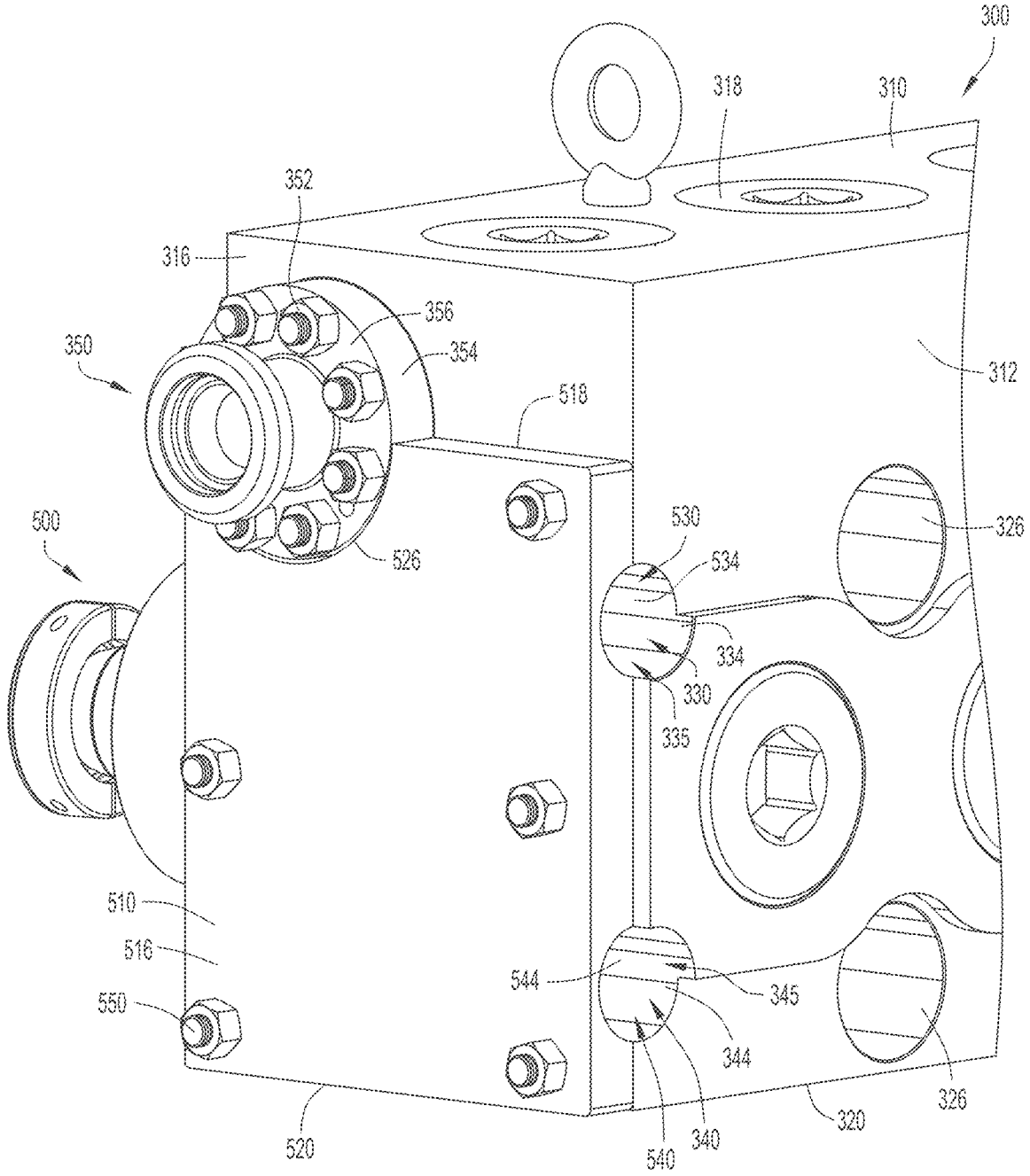
FIG. 5 is a perspective end view showing the plate illustrated in FIG. 4 coupled to the fluid end illustrated in FIG. 3.

Turning to FIG. 5, a perspective view of the fluid end 300 with the plate 500 coupled or mounted to the fluid end casing 310 is illustrated. Plate 500 is positioned proximate to end surface 312 of the casing 310. The curved surface portion 526 of plate 500 sized and shaped so that its profile matches the profile of the outer surface 356 of the discharge end flange 352. As a result, plate 500 can be moved upwardly relative to the casing 310 until the discharge end flange 352 engages the cavity 528 in the body 510 of the plate 500.

Plate 500 is moved so that its surfaces can be aligned with the surfaces of the fluid end casing 310. Opposite surfaces 512 and 514 of plate body 510 are aligned with and substantially coplanar with surfaces 312 and 314 of fluid end casing 310, respectively. Cavity 528 in plate body 510 is sized so that it receives a sufficient portion of flange 352 to allow the lower surface 520 of body 510 to be aligned with and substantially coplanar with lower surface 320 of fluid end casing 310.

To couple the plate 500 to the fluid end casing 310, several connectors 550, such as bolts, are inserted into through holes 524 (see FIG. 4) in plate body 510. The connectors 550 engage corresponding openings formed in fluid end casing 310 and are tightened to secure the plate 500.

When the plate 500 is coupled to the fluid end casing 310, recesses 330 and 530 are aligned with and proximate to each other, and recesses 340 and 540 are aligned with and proximate to each other. In particular, recess portions 332 and 334 are aligned with recess portions 532 and 534, respectively, which results in recesses 330 and 530 collectively forming a through passageway or hole 335. Passageway 335 extends from one side of the plate 500/fluid end casing 310 combination to the opposite side of that combination. As each of recess 330 and 530 is sized to receive a portion of a stay rod, the passageway 335 formed by the combination of recess 330 and recess 530 is sized to receive a stay rod and permit the stay rod to extend between opposite sides of the plate 500/fluid end casing 310 combination.

Similarly, recess portions 342 and 344 are aligned with recess portions 542 and 544, respectively, which results in recesses 340 and 540 collectively forming a through passageway or hole 345. Passageway 345 extends from one side of the plate 500/fluid end casing 310 combination to the opposite side of that combination. As each of recess 340 and recess 540 is sized to receive a portion of a stay rod, the passageway 345 formed by the combination of recess 340 and recess 540 is sized to receive a stay rod and permit the stay rod to extend between opposite sides of the plate 500/fluid end casing 310 combination. Stay rod passageways 335 and 345 are aligned with and parallel to each other.

Figure 6:
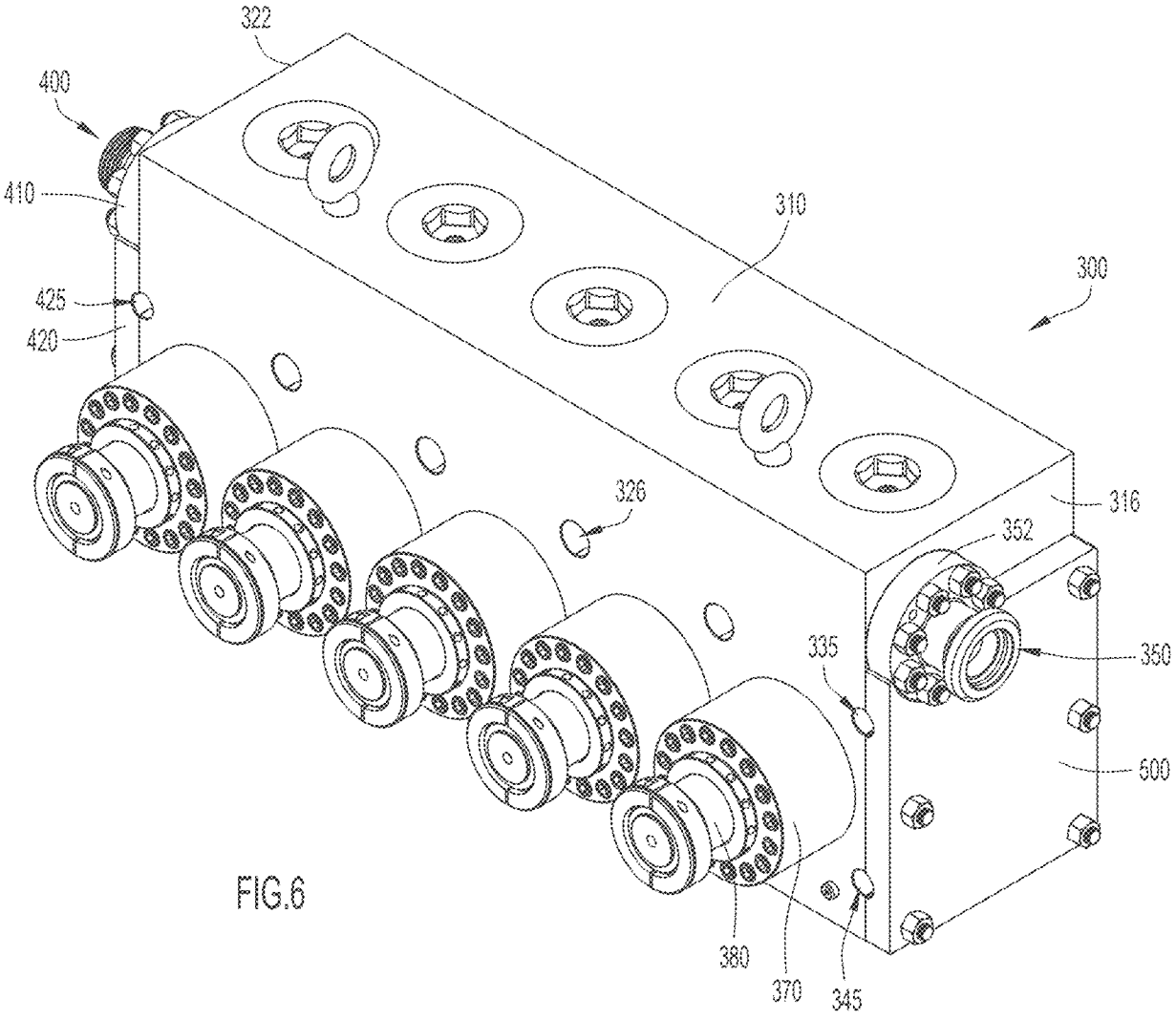
FIG. 6 is a perspective top view of the fluid end illustrated in FIG. 5.

Referring to FIG. 6, a perspective view illustrating the fluid end 300 is shown. The fluid end 300 includes a casing 310 with opposite end surfaces 316 and 322. As discussed above, plate 500 is coupled to end surface 316 and located proximate to the flange 352 of the discharge end 350. The stay rod passageways 335 and 345 formed by plate 500 and fluid end casing 310 are shown. The through holes 326 formed the main body of casing 310 for stay rods are shown as well.

In addition, casing 310 includes an inlet end 400 opposite to discharge end 350. Inlet end 400 includes a flange 410, which has a generally cylindrical profile with a curved outer surface. The fluid end 300 includes a plate 420 that is formed as a mirror image to plate 500. Plate 420 includes recess portions therein similar to recesses 530 and 540. The recess portions of plate 420 cooperate with recess portions formed in end surface 322 to form a pair of stay rod passageways 425 and 435 (see FIG. 6 for passageway 425 and FIG. 7 for passageway 435). The stay rod passageways 425 and 435 formed between plate 420 and fluid end casing 310 are similar to stay rod passageways 335 and 345 formed between plate 500 and fluid end casing 310.

Figure 7:
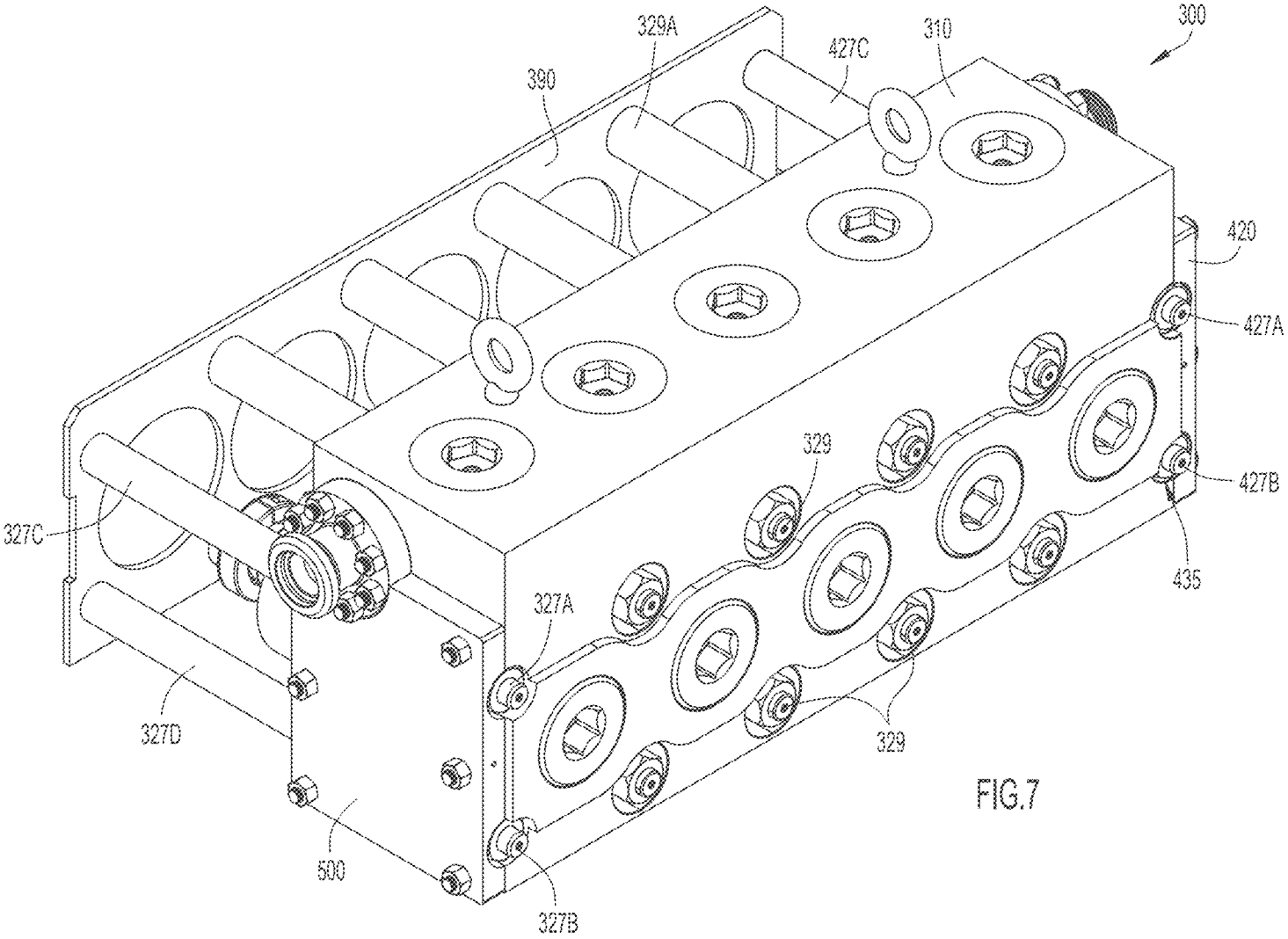
FIG. 7 is a perspective top view of the fluid end illustrated in FIG. 6 with mounting components coupled thereto.

Referring to FIG. 7, a different perspective view of fluid end 300 is illustrated, with fluid end 300 including additional components relative to the view in FIG. 6. Stay rods 329 are inserted into the through holes 326 formed in the fluid end casing 310 and engage a mount plate 390, which can be coupled to a power end (not shown) of a pump.

Plates 420 and 500 are coupled to fluid end casing 310, as discussed above. Stay rods or tie rods 327A and 327B are located in passageways 335 and 345, respectively, and extend from the casing 310 and engage the mount plate 390. Similarly, stay rods 427A and 427B are located in passageways 425 and 435, respectively, and extend from the casing 310 and engage the mount plate 390 as well. Each of the stay rods 327A, 327B, 329, 427A, and 427B engages a power end of a pump and couples or mounts the fluid end 300 to the power end. In FIG. 7, the stay rod sleeves are illustrated as being located on respective ones of the stay rods. Stay rod sleeves 327C, 327D, 329A, and 427C are shown. As a result of utilizing plates 420 and 500, the outer stay rods 327A, 327B, 427A, and 427B, which are outside of the envelope of the fluid end casing 310, are captured by plates 42 and 500 and the fluid end casing 310.

Figure 8:
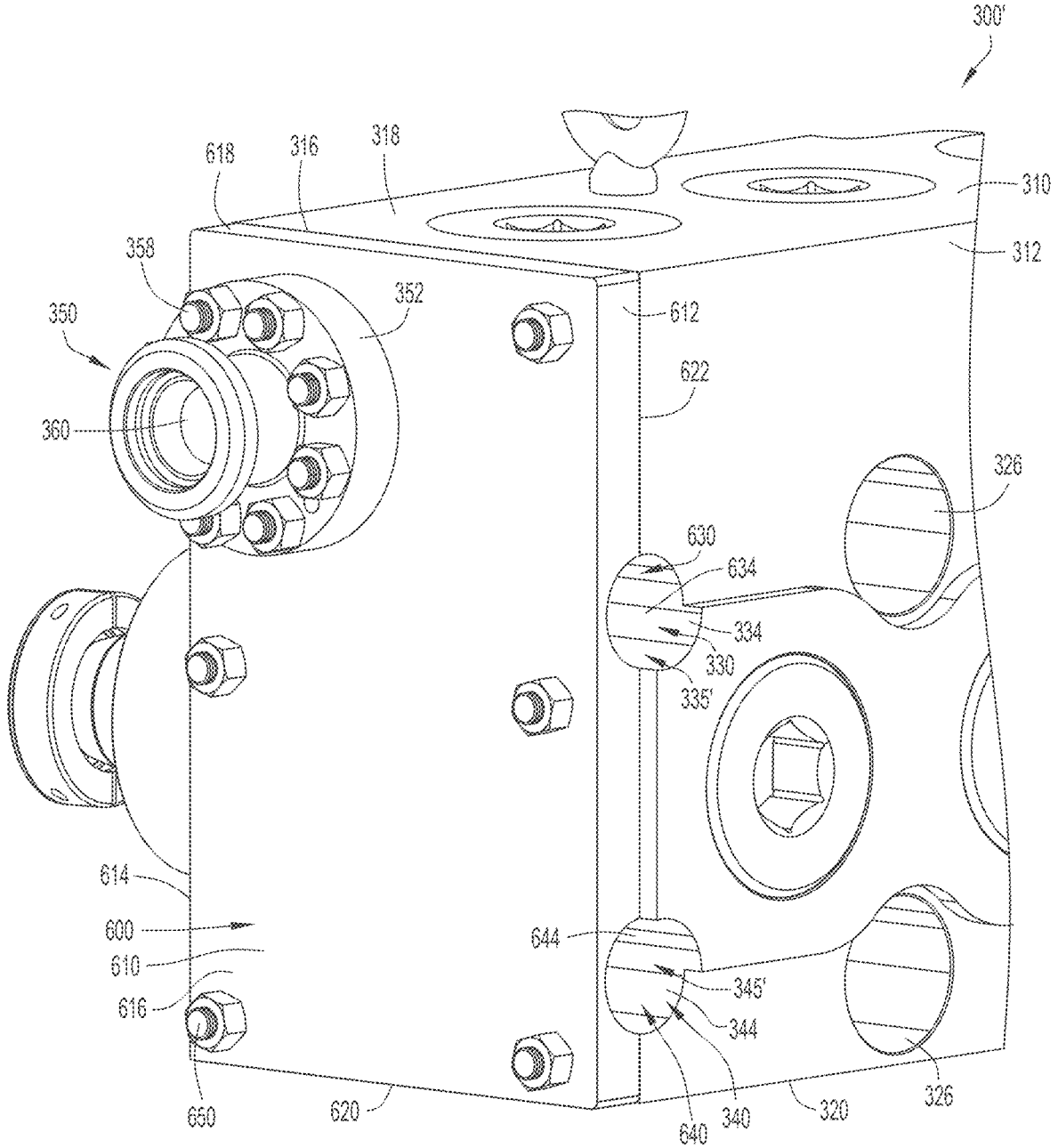
FIG. 8 is a close-up perspective end view of another embodiment of a plate according to the present invention coupled to the fluid end illustrated in FIG. 3.

Referring to FIG. 8, a perspective view of an alternative embodiment of a fluid end according to the present invention is illustrated. In this embodiment, nearly all of the features of the fluid end 300' are similar to those of fluid end 300 described above, and accordingly, similar reference numbers are utilized for fluid end 300'. The differences are the mounting of the discharge end 350 and the plate that is coupled to the fluid end casing. In FIG. 8, only a portion of the fluid end 300' is illustrated. It is to be understood that a plate similar to plate 600 described below can be coupled to the opposite end surface of fluid end casing 310.

As shown in FIG. 8, a plate 600 is coupled to fluid end casing 310. In this embodiment, plate 600 has several features similar to plate 500. However, the overall size of plate 600 and its placement proximate to fluid end casing 310 are slightly different from plate 500. Plate 600 includes a body 610 that has a first surface 612 and a second surface 614 opposite to the first surface 612. Body 610 also as an outer surface 616 and an opposite inner surface 622, and an upper surface 618 and an opposite lower surface 620. Body 610 also includes several through holes formed therein that receive connectors 650, such as bolts, to couple or mount the plate 600 to the fluid end casing 310.

The vertical and horizontal dimensions of plate 600 are similar to the vertical and horizontal dimensions of fluid end casing 310. As a result, when plate 600 is positioned proximate to fluid end casing 310, surfaces 612 and 614 of plate 600 are aligned with and co-planar with surfaces 312 and 314 of fluid end casing 310, respectively. Similarly, upper surfaces 618 and 318 are aligned with each other and are co-planar, and lower surfaces 620 and 320 are aligned with each other and are co-planar.

In this embodiment, plate 600 is secured to the fluid end casing 310 before the discharge end 350 is secured to the fluid end casing 310. The plate 600 includes an opening (not shown) extending therethrough that is aligned with outlet 360. Otherwise, plate 600 covers all of end surface 316. Once plate 600 is coupled to fluid end casing 310, the discharge end 350 is secured to plate 600. Connectors 358, such as bolts, are inserted through openings in the flange 352, through openings (not shown) in plate 600, and into openings formed in end surface 316 of the fluid end casing 310. In an alternative embodiment, the connectors 358 may only extend into openings formed in plate 600.

Plate 600 has a recess 630 and a recess 640 formed therein, which are similar to recess 530 and recess 540 formed in plate 500, respectively. Recess 630 includes a larger radius portion 634 which is proximate to larger radius portion 334 of recess 330. Recess 640 includes a larger radius portion 644 which is proximate to larger radius portion 344 of recess 340. Recess 630 and recess 330 collectively form through hole or passageway 335', which is sized to receive a stay rod. Similarly, recess 640 and recess 340 collectively form through hole or passageway 345', which is sized to receive a stay rod.

By coupling the plates 420, 500, and/or 600 to an end surface of a fluid end casing 310, the overall dimension of the fluid end casing 310 increases, thereby enabling the forged fluid end casing 310 to have more uses, including the capturing of outer stay rods that are located outside of the profile or envelope of the fluid end casing or block. In some embodiments, the plates 420, 500, and 600 can be formed using a material that is cheaper than the material of the forged fluid end casing, thereby reducing the overall manufacturing costs.

In exemplary manufacturing and assembly process, the plates are first pre-machined in the form of plate 500 in FIG. 4 or plate 600 in FIG. 8, and then installed on to the pre-machined smaller forging fluid end block or casing 310 utilizing connectors 550 or 650, such as stud/nuts or standard bolts. The plates can either be partially capturing the side of the fluid end (see plate 500 in FIG. 5) or fully capturing the side of the fluid end (see plate 600 in FIG. 8). Plate 600, which fully captures the side of the fluid end, also captures the discharge flange 352 and allows it to be offset to resolve any geometry and stress issues. Once the plates 420, 500, and/or 600 are installed, the assembly is then taken to a CNC machine to square the interfacing faces with the tie rod nut and sleeve. When the final tie rod machining process is complete, the fluid end can be installed in the normal tie rod configuration similarly to a larger forging fluid end that captures the outer tie rods.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end assembly of a high-pressure reciprocating pump, comprising:

a housing having at least one bore formed therein, the housing having a first surface, a second surface opposite the first surface, a first upper surface, a first lower surface opposite the first upper surface, and a first end surface; and a plate coupled to the housing proximate to the first end surface of the housing, the plate having a third surface, a fourth surface opposite the third surface, a second upper surface, a second lower surface opposite the second upper surface, and a second end surface, and a first inner surface, wherein when the plate is coupled to the housing, a tie rod can be captured between the plate and the housing and the tie rod extending parallel to the first end surface.

2. The fluid end assembly of claim 1, wherein when the plate is coupled to the housing, the third surface is aligned with and co-planar with the first surface, the fourth surface is aligned with and co-planar with the second surface, and the second lower surface is aligned with and co-planar with the first lower surface.

3. The fluid end assembly of claim 1, wherein the second upper surface of the plate includes a curved surface portion that defines a cavity, the housing includes a discharge flange extending from the first end surface, and a portion of the discharge flange engages the cavity.

4. The fluid end assembly of claim 1, wherein the second upper surface is aligned with and co-planar with the first upper surface.

5. The fluid end assembly of claim 1, wherein the first inner surface of the plate is proximate to the first end surface of the housing when the plate is coupled to the housing.

6. The fluid end assembly of claim 1, wherein the housing includes a third end surface opposite to the first end surface, the plate is a first plate, and the fluid end assembly further comprises:

a second plate coupled to the housing proximate to the third end surface, the second plate and the housing defining another passageway therebetween for another tie rod.

7. The fluid end assembly of claim 1, wherein the housing includes a first recess formed in the first end surface, the first recess is sized to receive a portion of the tie rod therein, the plate includes a second recess formed in the first inner surface, the second recess is sized to receive a portion of the tie rod therein, the second recess is proximate to the first recess, and the first recess and the second recess collectively form a passageway for the tie rod.

8. The fluid end assembly of claim 7, wherein the passageway is a first passageway, the tie rod is a first tie rod, the housing includes a third recess formed in the first end surface, the plate includes a fourth recess, the fourth recess is proximate to the third recess, the third recess and the fourth recess collectively form a second passageway, and a second tie rod can be captured in the second passageway between the plate and housing.

9. A fluid end assembly of a high-pressure reciprocating pump, comprising:

a housing having at least one bore formed therein, the housing having a first end surface and a second end surface opposite the first end surface, the first end surface having a first recess formed therein and extending therealong, the second end surface having a second recess formed therein and extending therealong;

a first plate coupled to the housing proximate to the first end surface, the first plate including a first inner surface located proximate to the first end surface of the housing, the first inner surface having a third recess formed therein and extending therealong, the third recess and the first recess collectively forming a first tie rod passageway; and a second plate coupled to the housing proximate to the second end surface, the second plate including a second inner surface located proximate to the second end surface of the housing, the second inner surface having a fourth recess formed therein and extending therealong, the fourth recess and the second recess collectively forming a second tie rod passageway.

10. The fluid end assembly of claim 9, wherein the housing includes a first upper surface, the first plate includes a second upper surface, and the second upper surface is aligned with and co-planar with the first upper surface when the first plate is coupled to the housing.

11. The fluid end assembly of claim 9, wherein each of the first recess and the third recess is sized to receive a portion of a first tie rod therein, and each of the second recess and the fourth recess is sized to receive a portion of a second tie rod therein.

12. The fluid end assembly of claim 9, wherein each of the first plate and the second plate is coupled to the housing via connectors extending through the respective first plate or second plate and into the housing.

13. The fluid end assembly of claim 9, wherein the first plate includes several surfaces, the housing includes several surfaces, and at least one of the several surfaces of the first plate is aligned with and is co-planar with one of the several surfaces of the housing.

14. The fluid end assembly of claim 13, wherein one of the several surfaces of the first plate is an upper surface, the upper surface includes a curved surface portion that defines a cavity, the housing includes a discharge flange extending from the first end surface, and a portion of the discharge flange engages the cavity.

15. A fluid end assembly of a high-pressure reciprocating pump, comprising:

a housing having at least one bore formed therein, the housing having a first end surface and a second end surface opposite the first end surface, the first end surface having a first recess formed therein, the second end surface having a second recess formed therein;

a first plate coupled to the housing proximate to the first end surface via at least one first connector, the first plate having a third recess formed therein, the third recess and the first recess collectively forming a first tie rod passageway;

a second plate coupled to the housing proximate to the second end surface via at least one second connector, the second plate having a fourth recess formed therein, the fourth recess and the second recess collectively forming a second tie rod passageway;

a first tie rod extending through the first tie rod passageway and extending parallel to the first end surface; and a second tie rod extending through the second tie rod passageway and extending parallel to the second end surface.

16. The fluid end assembly of claim 15, wherein the first plate includes several surfaces, the housing includes several surfaces, and at least one of the several surfaces of the first plate is aligned with and is co-planar with one of the several surfaces of the housing.

17. The fluid end assembly of claim 15, wherein one of the several surfaces of the first plate is an upper surface, the upper surface includes a curved surface portion that defines a cavity, the housing includes a discharge flange extending from the first end surface, and a portion of the discharge flange engages the cavity.

18. The fluid end assembly of claim 15, wherein the housing includes a first upper surface, the first plate includes a second upper surface, and the second upper surface is aligned with and co-planar with the first upper surface when the first plate is coupled to the housing.

19. The fluid end assembly of claim 15, wherein each of the first recess and the third recess receives a portion of the first tie rod therein, and each of the second recess and the fourth recess receives a portion of the second tie rod therein.

20. The fluid end assembly of claim 15, wherein each of the first tie rod passageway and the second tie rod passageway includes a first portion with a first inner diameter and a second portion with a second inner diameter, the second inner diameter being larger than the first inner diameter.

* * * * *